US008508421B2

(12) United States Patent
Mishan et al.

(10) Patent No.: US 8,508,421 B2
(45) Date of Patent: Aug. 13, 2013

(54) HARDENED WAVE-GUIDE ANTENNA

(75) Inventors: Shaul Mishan, Rosh Haayin (IL); Reuven Bauer, Rehovot (IL)

(73) Assignee: Elta Systems Ltd., Ashdod (IL)

( * ) Notice: Subject to any disclaimer, the term of this patent is extended or adjusted under 35 U.S.C. 154(b) by 0 days.

(21) Appl. No.: 13/504,677

(22) PCT Filed: Oct. 12, 2010

(86) PCT No.: PCT/IL2010/000829

§ 371 (c)(1),
(2), (4) Date: Aug. 17, 2012

(87) PCT Pub. No.: WO2011/051931

PCT Pub. Date: May 5, 2011

(65) Prior Publication Data

US 2012/0306710 A1 Dec. 6, 2012

(30) Foreign Application Priority Data

Oct. 29, 2009 (IL) ..... 201812

(51) Int. Cl.
*H01Q 13/10* (2006.01)

(52) U.S. Cl.
USPC ..... 343/771; 343/776; 343/789; 343/853

(58) Field of Classification Search
USPC ..... 343/771, 789, 776, 853
See application file for complete search history.

(56) References Cited

U.S. PATENT DOCUMENTS

| | | | | |
|---|---|---|---|---|
| 3,226,722 | A * | 12/1965 | Yang | 343/780 |
| 3,665,480 | A | 5/1972 | Fassett | |
| 3,720,953 | A * | 3/1973 | Ajioka | 343/771 |
| 3,778,838 | A * | 12/1973 | Clavin | 343/727 |
| 4,287,518 | A | 9/1981 | Ellis, Jr. | |
| 4,675,685 | A | 6/1987 | Finken | |
| 4,760,403 | A * | 7/1988 | Grim | 343/786 |
| 4,821,040 | A | 4/1989 | Johnson et al. | |
| 4,821,042 | A | 4/1989 | Ohe et al. | |
| 5,276,457 | A * | 1/1994 | Agarwal et al. | 343/789 |
| 5,311,200 | A * | 5/1994 | Walker et al. | 343/771 |
| 5,402,134 | A | 3/1995 | Miller et al. | |
| 6,023,243 | A | 2/2000 | Frank | |
| 6,297,774 | B1 * | 10/2001 | Chung | 343/700 R |
| 6,977,621 | B2 * | 12/2005 | Kelly et al. | 343/771 |

FOREIGN PATENT DOCUMENTS

EP 1 076 379 A2 2/2001

OTHER PUBLICATIONS

Gonzalez De Aza et al., "Broad-Band Cavity-Backed and Capacitively Probe-Fed Microstrip Patch Arrays," *IEEE Transactions on Antennas and Propagation*, May 2000, pp. 784-789, vol. 48, No. 5, IEEE.

May 24, 2013 Office Action issued in European Patent Application. No. 10 773 408.9.

* cited by examiner

*Primary Examiner* — Tho G Phan
(74) *Attorney, Agent, or Firm* — Oliff Berridge, PLC

(57) ABSTRACT

An antenna element and a phased array antenna including a plurality of such antenna elements are described. The antenna element includes a waveguide configured for operating in a below-cutoff mode and having a cavity, an exciter configured for exciting the waveguide, and a shield. The shield includes a holder arranged within the cavity, and a front plate mounted on the holder and disposed over at least a part of the exciter.

20 Claims, 14 Drawing Sheets

HARDENED WAVE-GUIDE ANTENNA

FIELD OF THE INVENTION

This invention relates to radio-frequency antenna structures and, more particularly, to low-profile hardened waveguide antennas.

BACKGROUND OF THE INVENTION

Mobile radio communications presently mainly rely on conventional whip-type antennas mounted to the roof, hood, or trunk of a motor vehicle. Although whip antennas generally provide acceptable mobile communications performance, they have a number of disadvantages. For example, a whip antenna must be mounted on an exterior surface of the vehicle, so that the antenna is unprotected from the weather, and may for example, be damaged by vehicle washes, unless temporarily removed.

The user of mobile radio equipment is often plagued today by the problem of vandalism of car radio antennas and burglary of the equipment. Indeed, the presence of a whip antenna on the exterior of a car is a good clue to thieves that a radio, telephone transceiver or other equipment is installed within the vehicle.

Varieties of covert antennas are known in the art. Such antennas are usually substantially flush-mounted to a vehicle, covered with fiberglass and refinished to blend with the rest of the car body. In particular, annular slot-type stripline antennas can be useful, as where such an antenna is to be substantially flush-mounted to a vehicle. One such annular slot-type stripline antenna element is described in U.S. Pat. No. 3,665,480. As discussed therein, the antenna element includes a pair of parallel conductive plates formed on opposite faces of a dielectric support structure, one of which has formed therein a generally annular radiating slot of substantially uniform width, and a feed element disposed between the parallel plates and extending radially into the central region of the annular slot for feeding electromagnetic energy into such a slot.

U.S. Pat. No. 4,821,040 describes a compact quarter-wavelength microstrip element especially suited for use as a mobile radio antenna. The antenna is not visible to a passerby observer when installed, since it is literally part of the vehicle. The microstrip radiating element is conformal to a passenger vehicle, and may, for example, be mounted under a plastic roof between the roof and the headliner.

U.S. Pat. No. 4,821,042 describes a vehicle antenna system including high frequency pickup type antennas concealed within the vehicle body for receiving broadcast waves. The high frequency pickups are arranged on the vehicle body at locations spaced apart from one another, that is, at least one adjacent to the vehicle roof and the other on a trunk hinge.

U.S. Pat. No. 5,402,134 describes a flat plate antenna module for use in a non-conductive cab of a motor vehicle and includes a dielectric substrate and one or more antenna loops arranged on the substrate. The substrate is adapted to be installed between the headliner of a cab and the dielectric roof. The module may include a CB antenna loop, an AM/FM antenna loop, a cellular mobile telephone antenna loop, and a global positioning system antenna, without the need for any antenna structure external to the cab. The antennae are arranged on the module in a nested configuration.

U.S. Pat. No. 6,023,243 describes a flat panel antenna for microwave transmission. The antenna comprises at least one printed circuit board, and has active elements including radiating elements and transmission lines. There is at least one ground plane for the radiating elements and at least one surface serving as a ground plane for the transmission lines. The panel is arranged such that the spacing between the radiating elements and their respective groundplane is independent of the spacing between the transmission lines and their respective groundplane. A radome may additionally be provided which comprises laminations of polyolefin and an outer skin of polypropylene.

SUMMARY OF THE INVENTION

Despite the prior art in the area of covert antennas, there is still a need in the art for further improvement in order to provide an antenna that might be substantially flush-mounted to a vehicle, has broad band performance and a reduced aperture. It would also be advantageous to have an antenna that would be sufficiently hardened in order to withstand vandalism, and harsh weather conditions. There is also a need and it would be advantageous to have an antenna that can survive the impact of road pebbles, gravel and other objects that can impact the antenna during exploitation.

The present invention partially eliminates disadvantages of cited reference techniques and provides a novel antenna element that is substantially covert and difficult to detect and vandalize.

According to one embodiment, the antenna element includes a waveguide configured for operating in a below-cutoff mode, an exciter configured for exciting the waveguide, and a shield configured for protecting the exciter. The waveguide has a cavity. The shield includes a holder arranged within the cavity, and a front plate mounted on the holder and disposed over at least a part of the exciter. A gap between the inner walls of the waveguide and the front plate defines an aperture of the waveguide. Preferably, the front plate is substantially flush with the aperture.

According to one embodiment, the exciter includes a printed-circuit antenna arranged within the cavity and configured for feeding the waveguide, and a feed arrangement coupled to the printed-circuit antenna at a feed point for providing radio frequency energy to the printed-circuit antenna. The printed-circuit antenna has a layered structure and includes a thin layer of a dielectric material, a patch printed on an under-side of the thin layer, and a substrate arranged between the patch and a bottom of the cavity. The patch includes an orifice that defines the location of the feed point.

According to one embodiment, the orifice is arranged at a verge of the patch, which is the distant edge from the center of the patch. According to one embodiment, the orifice is arranged within the solid portion of the patch.

According to one embodiment, the printed-circuit antenna also includes a pad and a stub coupled to the pad. The pad and stub are both printed on the upper side of the thin layer and arranged under the orifice of the patch.

According to an embodiment, the waveguide is a circular waveguide. In this case, the patch, the thin layer and the substrate all have ring shapes hollowed out in the ring center to define a lumen.

According to an embodiment, the holder of the shield is inserted through the lumen in the center of the layered structure formed by the patch, the thin layer and the substrate.

According to an embodiment, the holder has a tubular shape and includes a tapered portion and a uniform portion. The tapered portion is tapered with contraction from the front plate towards a uniform portion located at the bottom of the cavity. The contraction of the holder extends from the front plate until the location of the printed-circuit antenna. The uniform portion can have a base threaded into the bottom of the cavity.

According to an embodiment, the feed arrangement includes a pin and a sleeve arranged within the substrate between the patch and the bottom of the cavity. The pin passes through a common hole arranged within the waveguide at the bottom of the cavity, the sleeve and the thin layer. The pin is connected to the pad at the feed point of the printed-circuit antenna.

According to an embodiment, the pin is surrounded with an isolator layer. The isolator layer can, for example, be made of teflon.

According to a further embodiment, the antenna element further comprises a radome mounted on the top of the antenna element over the aperture.

According to another aspect of the present invention, there is provided a phased array antenna that comprises a plurality of the antenna elements described above, and a beam steering system coupled to the antenna elements and configured for steering an energy beam produced by said phased array antenna.

According to one embodiment, the waveguides of the antenna elements are arranged in a common conductive ground plane and spaced apart at a predetermined distance from each other.

According to another embodiment, the antenna elements have individual waveguides. Each waveguide is arranged in an individual conductive ground plane and spaced apart at a predetermined distance from each other.

The antenna element of the present invention has many of the advantages of the prior art techniques, while simultaneously overcoming some of the disadvantages normally associated therewith.

The antenna element of the present invention can generally be configured to operate in a broad band within the frequency range of about 20 MHz to 80 GHz.

The antenna element according to the present invention may be efficiently manufactured. The printed circuit part of the antenna (e.g., exciter) can, for example, be manufactured by using printed circuit techniques.

The installation of the antenna element and antenna array of the present invention is relatively quick and easy and can be accomplished without substantial altering a vehicle in which it is to be installed.

The antenna element according to the present invention is of durable and reliable construction.

The antenna element according to the present invention may be readily conformed to complexly shaped surfaces and contours of a mounting platform. In particular, it can be readily conformable to a car or other structures.

There has thus been outlined, rather broadly, the more important features of the invention in order that the detailed description thereof that follows hereinafter may be better understood. Additional details and advantages of the invention will be set forth in the detailed description, and in part will be appreciated from the description, or may be learned by practice of the invention.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

Figure 1:
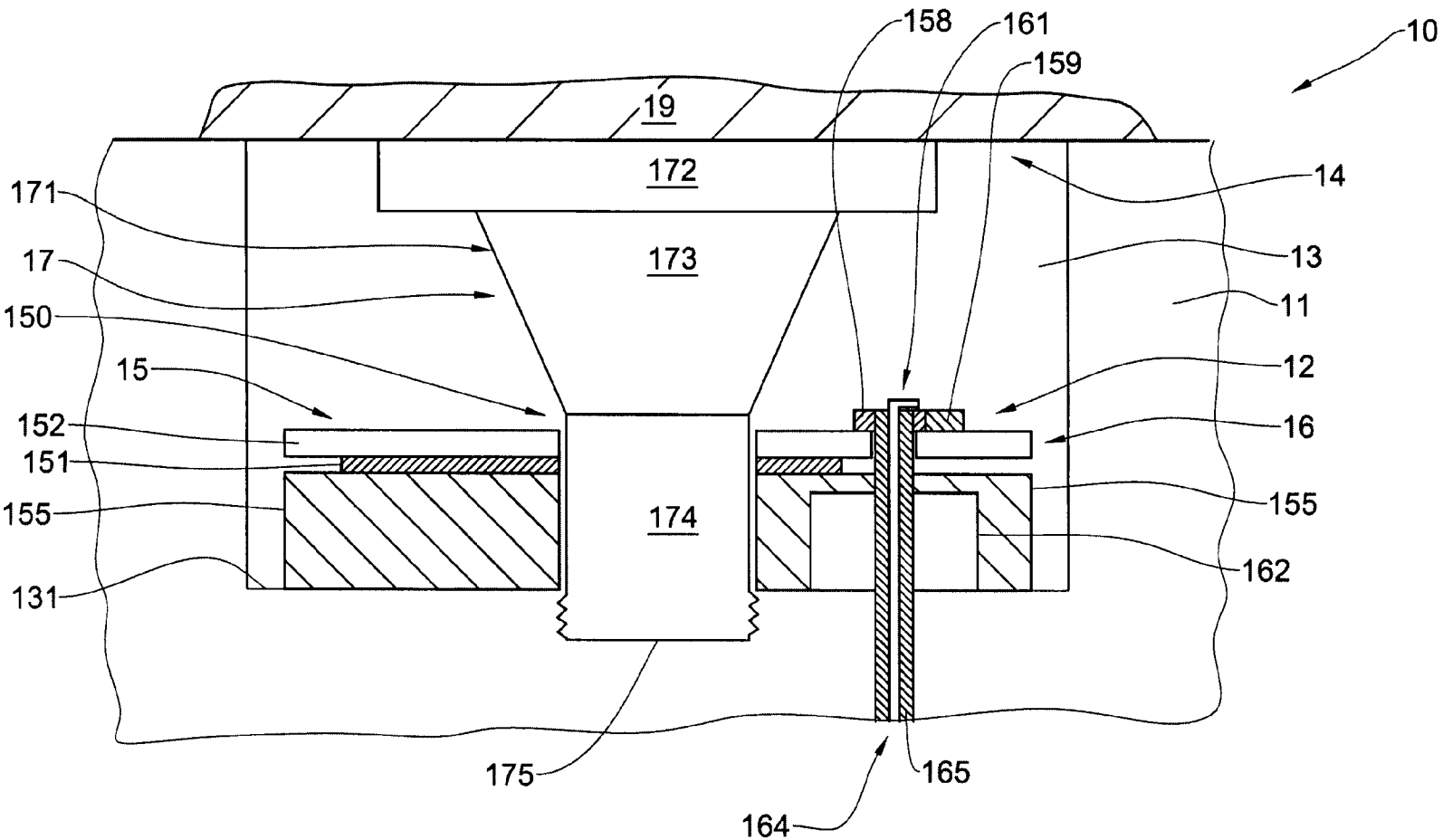
FIG. 1 is a schematic side cross-sectional fragmentary view of a single antenna element, according to one embodiment of the present invention.

The principles of the antenna according to the present invention may be better understood with reference to the drawings and the accompanying description, wherein like reference numerals have been used throughout to designate identical elements. It being understood that these drawings which are not necessarily to scale, are given for illustrative purposes only and are not intended to limit the scope of the invention. Examples of constructions, materials, dimensions, and manufacturing processes are provided for selected elements. Those versed in the art should appreciate that many of the examples provided have suitable alternatives which may be utilized.

Referring now to the drawings, FIG. 1 illustrates a schematic side cross-sectional fragmentary view of an antenna element 10, according to one embodiment of the present invention. The antenna element 10 includes a waveguide 11 having a cavity 13 and configured for operating in a below-cutoff mode. The antenna element 10 also includes an exciter (shown schematically by a reference numeral 12) configured for exciting the waveguide 11. The exciter 12 includes a printed-circuit antenna (shown schematically by a reference numeral 15) arranged within the cavity 13, and a feed arrangement (shown schematically by a reference numeral 16) configured for feeding the printed-circuit antenna 15. The feed arrangement 16 is coupled to the printed-circuit antenna 15 at a feed point 161 for providing radio frequency energy thereto. In turn, the printed-circuit antenna 15 is configured for feeding the waveguide 11.

Preferably, but not mandatory, the waveguide 11 is a circular waveguide. It should be noted that using a circular waveguide has a number of distinct advantages. One advantage is that a circular waveguide, owing to its symmetry, can operate in any polarization. From a mechanical point of view the circular waveguide is appropriate because of its mechanical simplicity and hardness.

The antenna element 10 also includes a shield (shown schematically by a reference numeral 17) configured to protect the printed-circuit antenna 15, for example, from vandalism, impact of road pebbles and gravel, and/or from other damaging actions. The shield 17 includes a holder 171 arranged within the cavity 13, and a front plate 172 mounted on the holder 171. A gap between the inner walls of the waveguide 11 and the front plate 172 defines an aperture 14 of the waveguide 11.

When the waveguide 11 is a circular waveguide, the front plate 172 preferably has a shape of a disk. It should be noted that the shield 17 has a twofold purpose. Electrically, the shield causes the antenna to operate the antenna above the cutoff frequency. This function of the shield is in addition to protecting the antenna from foreign elements.

According to one embodiment, the holder 171 has a tubular shape and includes a tapered portion 173 having a varied diameter, and a uniform portion 174 having a uniform diameter. The tapered portion 173 is tapered with contraction from the front plate (disk) 172 towards a uniform portion 174 that is located at a bottom 131 of the cavity 13.

When the waveguide 11 is a circular waveguide, the printed-circuit antenna 15 has a ring shape with a circular lumen 150 arranged in the center of the ring. As shown in FIG. 1, the contraction of the holder 171 can extend from the front plate 172 up to the location of the printed-circuit antenna 15. The uniform portion 174 of the holder 171 passes through the lumen 150.

According to an embodiment, the uniform portion 174 of the holder 171 is attached to the bottom 131 of the cavity 13. The connection of the holder 171 to the bottom 131 can, for example, be made with a laser weld, plasma weld pulse, electromagnetic weld or other welding process. Moreover, such fixing may be done by soldering, brazing, crimping, application of glues or by any other known technique depending on the material selected for each component. When desired, the holder 171 can include a base 175 of the uniform portion 174 that can be threaded into the waveguide 13 at the bottom 131 of the cavity 13. When desired, the base 175 of the holder 171 can have a screw thread for screwing the shield 17 to the waveguide 13 at the bottom 131.

The front plate 172 is disposed over the printed-circuit antenna 15 of the exciter 12, and is substantially flush with the aperture 14 and does not protrude. This provision can prevent the onset of surface waves.

There is a wide choice of materials available suitable for the antenna element 10. The waveguide 11 can, for example, be formed from aluminum to provide a lightweight structure, although other metallic, materials, e.g., zinc plated steel, etc. can also be employed.

The shield 17 can, for example, be formed from a hard and strong material to provide good protection from vandalism. Examples of the material suitable for the shield 17 include, but are not limited to, metallic materials.

According to a further embodiment, the antenna element 10 can include a radome 19 mounted on the top of the antenna element over the aperture 14. Placement of a relatively thin radome ensures, inter alia, that the antenna can be waterproof. As will be shown hereinbelow, the thickness of radome affects to a very large extent the resonant frequency of the antenna.

When desired, the space in the cavity 13 between the printed-circuit antenna 15 and the aperture 14 can be filled with a dielectric material.

Exemplary values of design parameters are shown in Table 1.

TABLE 1

Exemplary values of design parameters of the antenna element 10

| Parameter | Value |
|---|---|
| Cavity Radius | 0.212λo |
| Cavity Length | 0.27λo |
| Thickness of Front Plate | 8 mm |
| Radius of Holder | 0.075λo |
| Taper Angle of Holder | 55.2° |
| Gap between the Front Disk of the Holder and Inner Walls of the Waveguide | 0.0475λo |
| Outer Radius of Printed Circuit | 0.167λo |
| Inner Radius of Printed Circuit | 0.090λo |
| Thickness of Substrate | 0.065λo |
| Radius of Orifice of Patch | 0.023λo |
| Radius of Pad | 0.022λo |
| Length of Microstrip Stub | 0.043λo |
| Width of Microstrip Stub | 0.0225λo |
| Distance of Pin from center | 0.11λo |
| Height of Sleeve | 0.0154λo |
| Radius of Sleeve | 0.0125λo |
| Thickness of Radome | 0.0054λo |

It should be noted that the geometric parameters of the antenna element are represented within the present description in the dimensions normalized to the value of the wavelength in free space λo. In particular, λo is defined by c/f, where c is the speed of light and f is the frequency of operation of the antenna element.

Figure 2A:
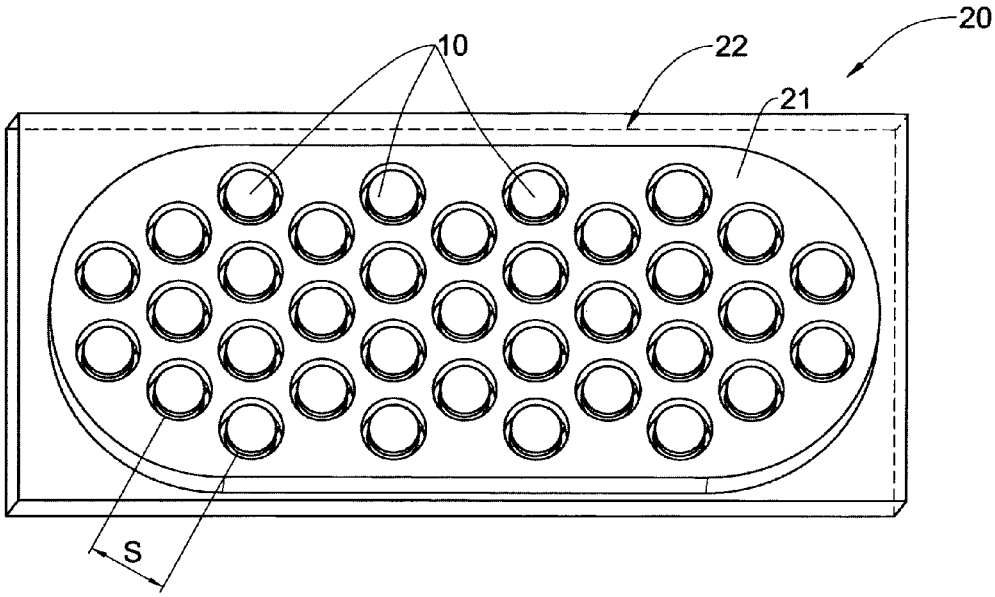
FIG. 2A is a perspective front view of an array antenna structure assembled from the single element antennas shown in FIG. 1, according to one embodiment of the present invention.

Referring to FIG. 2A, the single element antenna described above with references to FIG. 1, can be implemented in a phase array antenna structure 20, taking the characteristics of the corresponding array factor. It should be noted that the phase array antenna structure 20 can be implemented in various ways.

For example, as shown in FIG. 2A, all the waveguides of the antenna elements 10 can be arranged within a common conductive ground plane 21. Alternatively, the plurality of the antenna elements 10 can have individual waveguides. In this case, each waveguide can, for example, be arranged in an individual conductive ground plane (not shown).

In the example shown in FIG. 2A, the antenna elements 10 are arranged in columns and rows, however other arrangements are also contemplated. It should also be noted that although the array antenna shown in FIG. 2A has an oval shape, it may alternatively take other shapes, including, but not limited to, a circular, polygonal (e.g., triangular, square, rectangular, quadrilateral, pentagon, hexagonal, etc) and other shapes. Accordingly, the number of the rows in which the antenna elements 10 are arranged can be equal to the number of the columns. Alternatively, the numbers of the rows and the columns in the antenna array can be different. Moreover, the number of the antenna elements 10 in neighboring rows can be either equal or different. Moreover, the arrangement of the antenna elements 10 in the array can be either regular or staggered, thereby forming a rectangular or triangular lattice.

It should still further be noted that the phase array antenna 20 may be used as a single radiator in conjunction with a transceiver device, or it may be combined together with additional antenna arrays to form a larger array antenna. And it should still further be noted that although the front side 22 of the array antenna shown in FIG. 2 has a planar shape, when desired, the array antenna may alternatively have a curved or undulated face.

Furthermore, this array antenna can include a beam steering system (not shown) coupled to the plurality of the antenna elements 10 and configured for steering an energy beam produced by the phased array antenna. The beam steering system is a known system that can, inter alia, include such components as T/R modules, DSP-driven switches, and other components required to control steerable multi-beams.

Figure 2B:
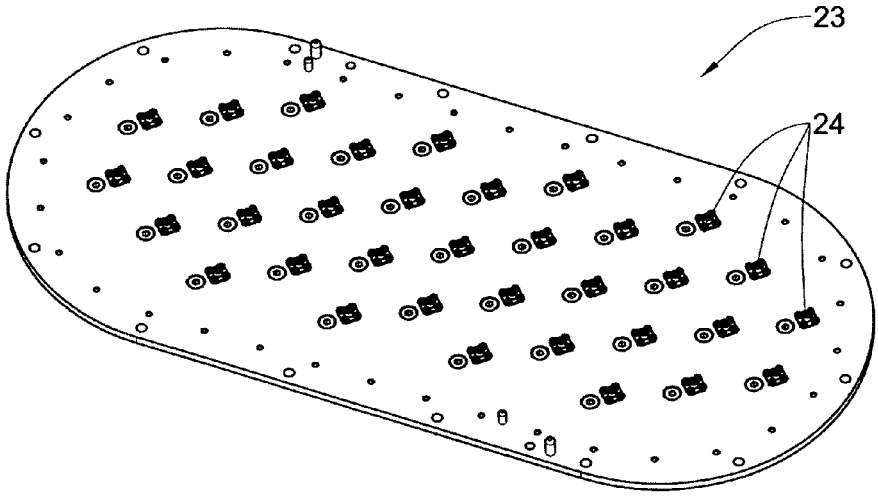
FIG. 2B is a perspective view of an interface for coupling the array antenna structure shown in FIG. 2A to other modules, according to one embodiment of the present invention.

FIG. 2B illustrates a perspective view of an interface 23 for coupling the array antenna shown in FIG. 2A to other modules, according to one embodiment of the present invention, For example, the interface 23 can couple the array antenna structure to T/R modules (not shown). In particular, each antenna element can be fed with a T/R module which is connected via a corresponding connector 24.

It was found that the configuration and parameters of the antenna element 10 and the array antenna structure 20 significantly affect their performance. Several examples of such dependencies will be illustrated herein below.

One of the important parameters of a phased array antenna is spacing S between antenna elements. The spacing S determines the required scan angle of the antenna. Specifically, the farther out the antenna needs to be scanned, the closer the element should be arranged in order to eliminate the onset of grating lobes into real space.

In operation, the spacing S has a major effect on the antenna element (10 in FIG. 1), since there is very strong electromagnetic coupling between the elements, which has a rather significant effect on the electrical characteristics of the antenna. This coupling has a strong effect on the return loss and element pattern of the antenna.

It should be understood that the spacing S between the elements 10 limits the diameter D of the cavity (13 in FIG. 1) of the element 10. On the other hand, it was found by the inventors that diameter of the cavity can affect the resonant frequency of the antenna.

Figure 3:
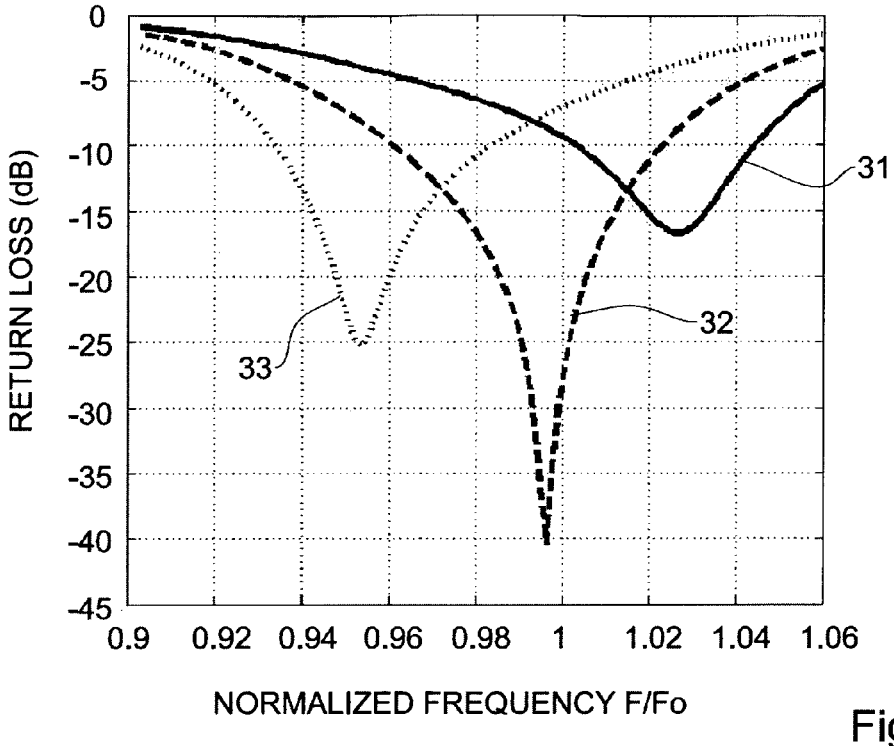
FIG. 3 illustrates exemplary graphs depicting the frequency dependence of the input reflection (return loss) coefficient for antenna element shown in FIG. 1 for various values of the radius of the cavity.

FIG. 3 illustrates exemplary graphs obtained by computer simulations depicting the frequency dependence of the input reflection (return loss) coefficient for antenna element shown in FIG. 1 for various values of the radius R of the cavity (13 in FIG. 1), while the other design parameters are held constant, as represented in Table 1.

The computer simulations were carried out when the radius R of the cavity was set to 0.200 λo (curve 31), 0.212 λo (curve 32), and 0.217 λo (curve 33), correspondingly. As was noted above, the radius R of the cavity as well as all other geometric parameters of the antenna element are represented herein in the dimensions normalized to the value of the wavelength in free space λo.

As can be seen, the resonant frequency decreases when the radius R of the cavity increases. In practice, the radius of the cavity should be chosen such that the antenna radiates at the desired frequency and bandwidth.

Another parameter of the cavity (13 in FIG. 1) which has an effect on the resonant frequency of the antenna is length L of the cavity. As mentioned above, the cavity operates below the cutoff frequency; therefore the length of the cavity is very critical.

Figure 4:
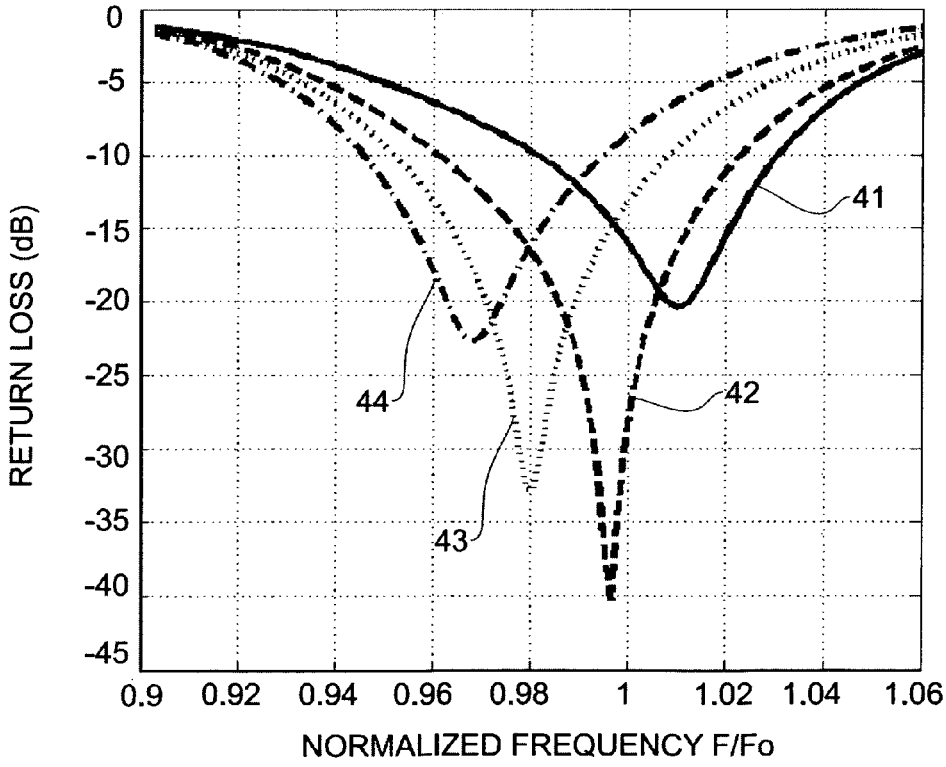
FIG. 4 illustrates exemplary graphs depicting the frequency dependence of the input reflection (return loss) coefficient for antenna element shown in FIG. 1 for various values of the cavity length.

FIG. 4 shows an example of computer simulation carried out to check how the change in cavity length L can affect the resonant frequency and bandwidth of the antenna element. The computer simulations were carried out when the cavity length L was set to 0.26 λo (curve 41), 0.27 λo (curve 42), 0.28 λo (curve 43), and 0.29 λo (curve 44) correspondingly, where λo is the characteristic wavelength. As can be seen, the resonant frequency decreases when the cavity length increases. In practice, the diameter of the cavity should be chosen such that the antenna radiates at the desired frequency and bandwidth.

Figure 5:
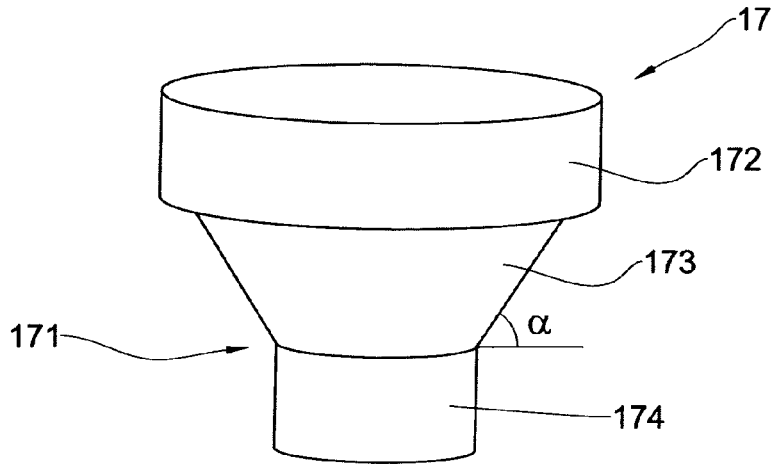
FIG. 5 is a perspective view of the shield of the single element antennas shown in FIG. 1, according to one embodiment of the present invention.

Referring to FIG. 1 and FIG. 5, the length L of the cavity is also determined by the length of the holder 171 of the shield 17 and the thickness of the front plate 172 mounted on top of the holder 171. As mentioned above, the front plate 172, inter alia, serves to protect the antenna from vandalism or from other damaging actions. Moreover, it is also configured to allow the cavity 13 to operate above the cutoff frequency. There are several parameters of the shield which needed to be designed in order for the antenna to operate properly.

Figure 6:
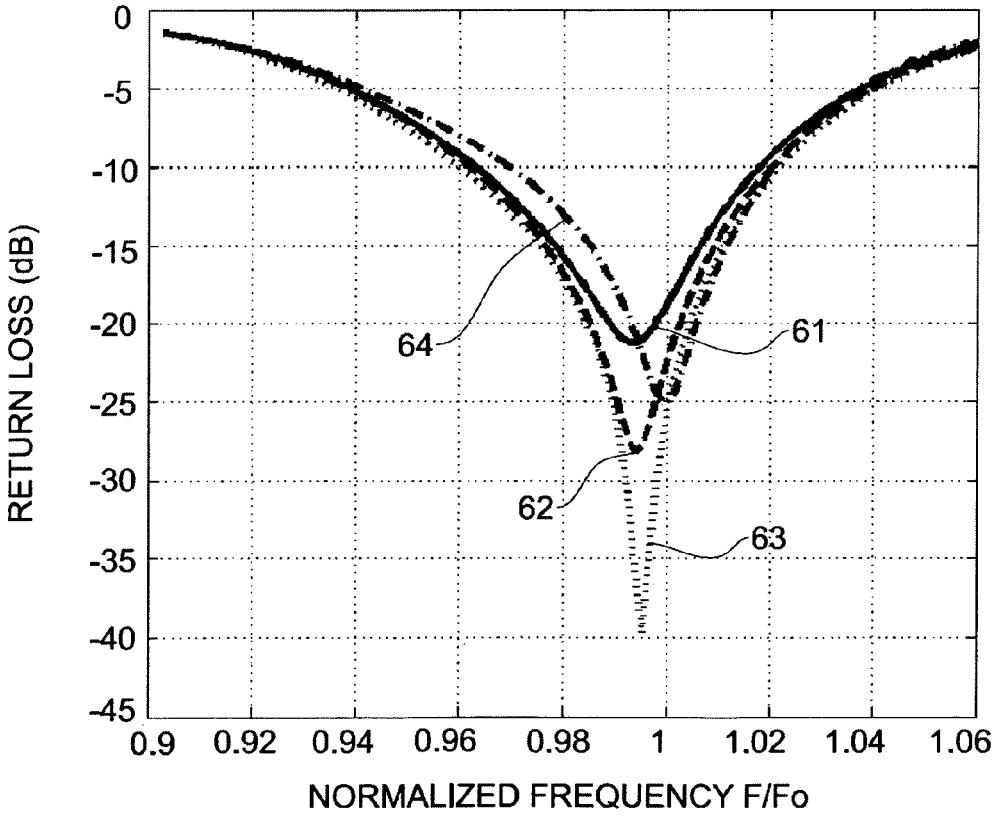
FIG. 6 illustrates exemplary graphs depicting the frequency dependence of the input reflection coefficient for antenna element shown in FIG. 1 for various values of the thickness of the front plate.

The first parameter for which the effect of its magnitude on the frequency response was checked was the thickness l of the front plate 172. Referring to FIG. 6, a computer simulation analysis was done to see the effect of the thickness of the front plate on the resonant frequency of the antenna element. The computer simulations were carried out in which the front plate was selected in the shape of a disk and the thickness l of the front disk was set to 6 mm (curve 61), 7 mm (curve 62), 8 mm (curve 63), and 9 mm (curve 64), correspondingly. As can be seen in FIG. 6, the variations in the thickness l of the front disk did not modify the resonant frequency and bandwidth of the antenna element very much. In addition, thickness l seems to have only a minor effect of the Return Loss of the antenna.

In practice, the thickness l of the front plate 172 should, inter alia, be chosen to withstand vandalism and other aggressive actions against the antenna. Preferably, the thickness of the front plate is equal to or greater than about 8 mm, in order to properly mechanically protect the antenna element. Accordingly, further computer simulations were carried out in which the front plate was selected in the shape of a disk and the thickness of the front disk was set to 8 mm. For this case, the following parameters were optimized: the radius δ of the holder 171 at the bottom portion 174, the tapering angle α of the holder, the radius r of the front disk and the length s of the cavity (14 in FIG. 1), i.e. a gap between the walls of the waveguide and the front disk 172.

Figure 7:
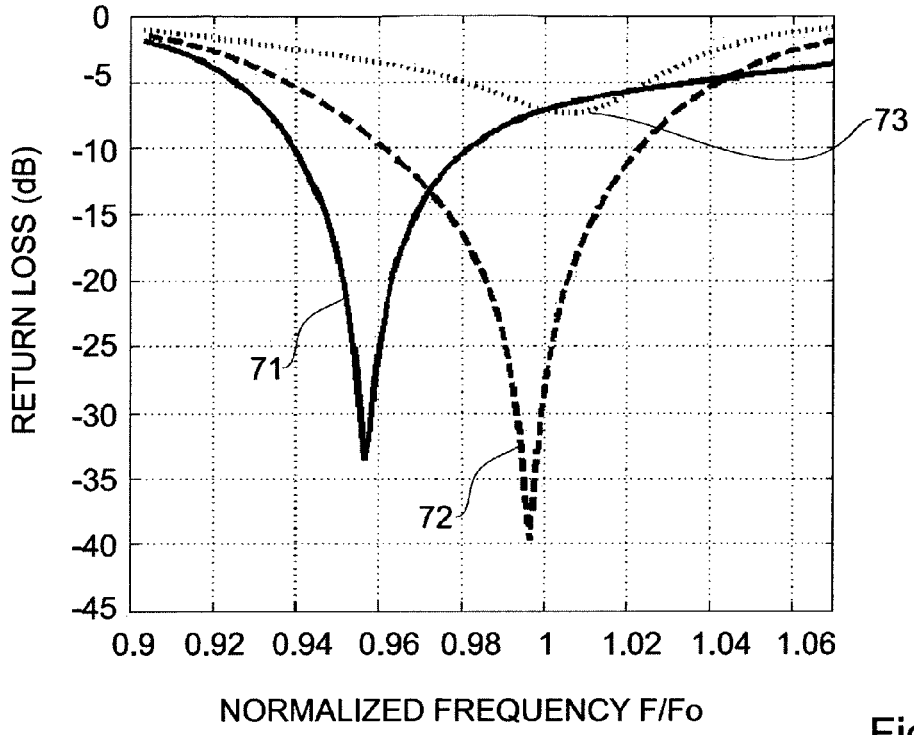
FIG. 7 illustrates exemplary graphs depicting the frequency dependence of the input reflection coefficient for antenna element shown in FIG. 1 for various values of the radius of the holder.

Referring to FIG. 7, another parameter for which the effect of its magnitude on the frequency response was checked was the radius r of the holder 171. The computer simulations were carried out when the radius r of the holder at the bottom portion was set to 0.065 λo (curve 71), 0.075 λo (curve 72), and 0.085 λo (curve 73), correspondingly. FIG. 7 shows the effect the radius of the holder on the resonance frequency and bandwidth of the antenna element. As can be seen, there are particular radii of the holder, such as 0.065 λo and 0.075 λo, at which the antenna is resonant, whereas at the radius of 0.085 λo the antenna element is not resonant.

Figure 8:
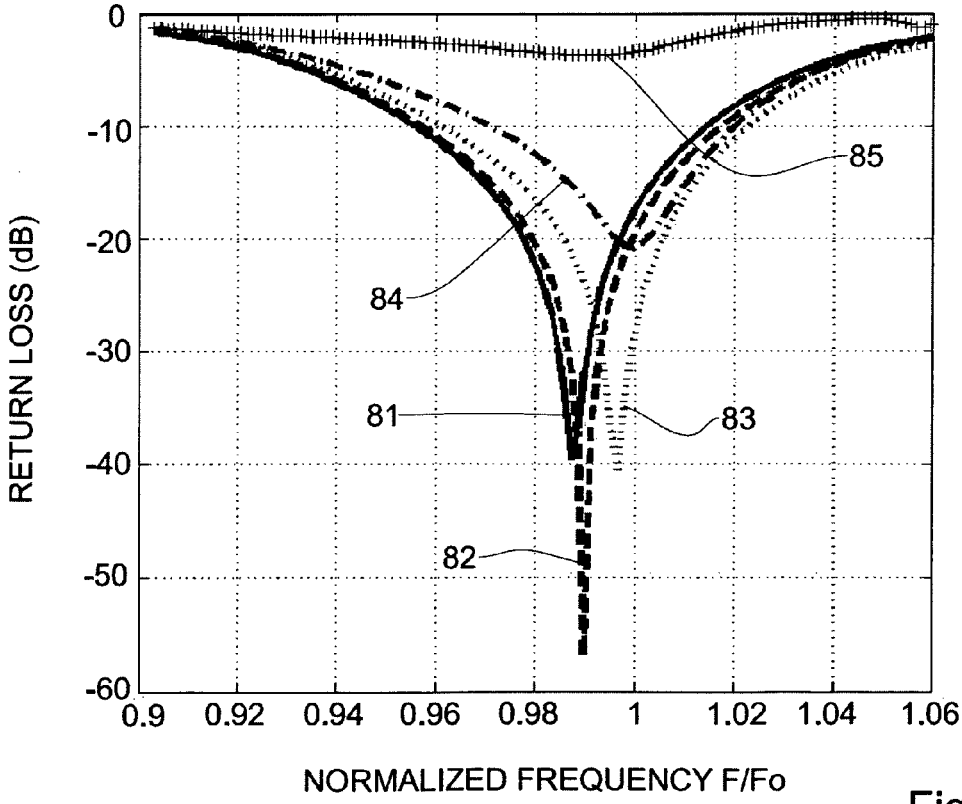
FIG. 8 illustrates exemplary graphs depicting the frequency dependence of the input reflection coefficient for antenna element shown in FIG. 1 for various values of the tapering angle of the holder.

Referring to FIG. 8, the further parameter that was analyzed is the effect of the tapering angle α of the holder on the frequency response of the antenna. The computer simulations were carried out when the tapering angle α of the holder was set to 52.3 degrees (curve 81), 55.2 degrees (curve 82), 57.7 degrees (curve 83), 58.9 degrees (curve 84), and 61.8 degrees (curve 85). As one can see, the tapering angle of the holder influences the resonant frequency and bandwidth of the antenna element. Modifying the angle of the holder has a profound effect on the resonant frequency of the antenna element. In addition, there are angles at which the antenna element almost does not resonate.

Figure 9:
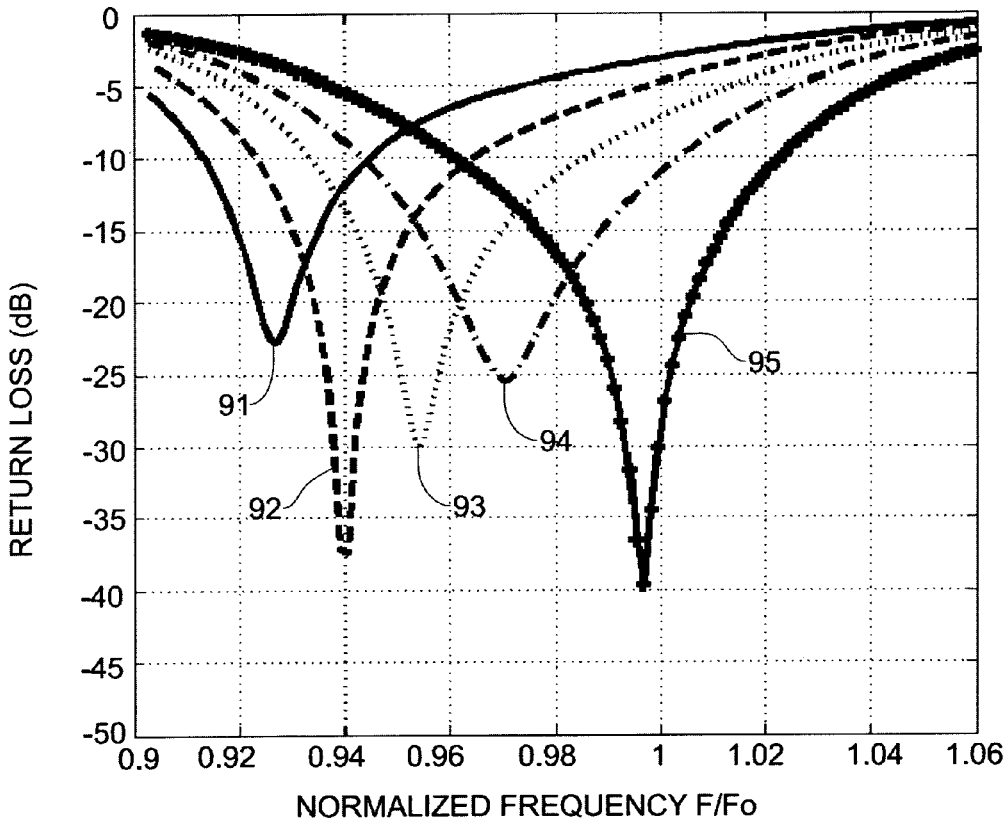
FIG. 9 illustrates exemplary graphs depicting the frequency dependence of the input reflection coefficient for antenna element shown in FIG. 1 for various dimensions of the gap between the front disk of the holder and the inner walls of the waveguide cavity.

Referring to FIG. 9, the next parameter that was analyzed is the effect of the gap between the front disk and the inner walls of the waveguide cavity (13 in FIG. 1), i.e., how the dimension of the waveguide's cavity (14 in FIG. 1) affects the performance of the antenna element. The computer simulations were carried out when the gap dimension was set to 0.0375 λo (curve 91), 0.040 λo (curve 92), 0.0425 λo (curve 93), 0.045 λo (curve 94), and 0.0475 λo (curve 95). As can be seen on FIG. 9, small changes in the gap dimension have a profound effect on the resonant frequency and bandwidth of the antenna element, therefore care must be taken to choose the correct gap.

In practice, the gap should preferably be chosen to be as small as possible. This should be done to make the face of the aperture as smooth as possible, thereby to prevent the antenna from penetrating any foreign objects into the cavity. On the other hand, the gap is the area from which the antenna radiates. Thus, when designing the antenna, one inherently chooses the largest possible gap that is acceptable. The designer then chooses the gap dimension from which the other antenna parameters can be optimized. The inventor believes that in practice, a gap that is suitable can, for example be the gap having dimensions in the range of about 0.0375 λo to 0.0475 λo.

Figure 10:
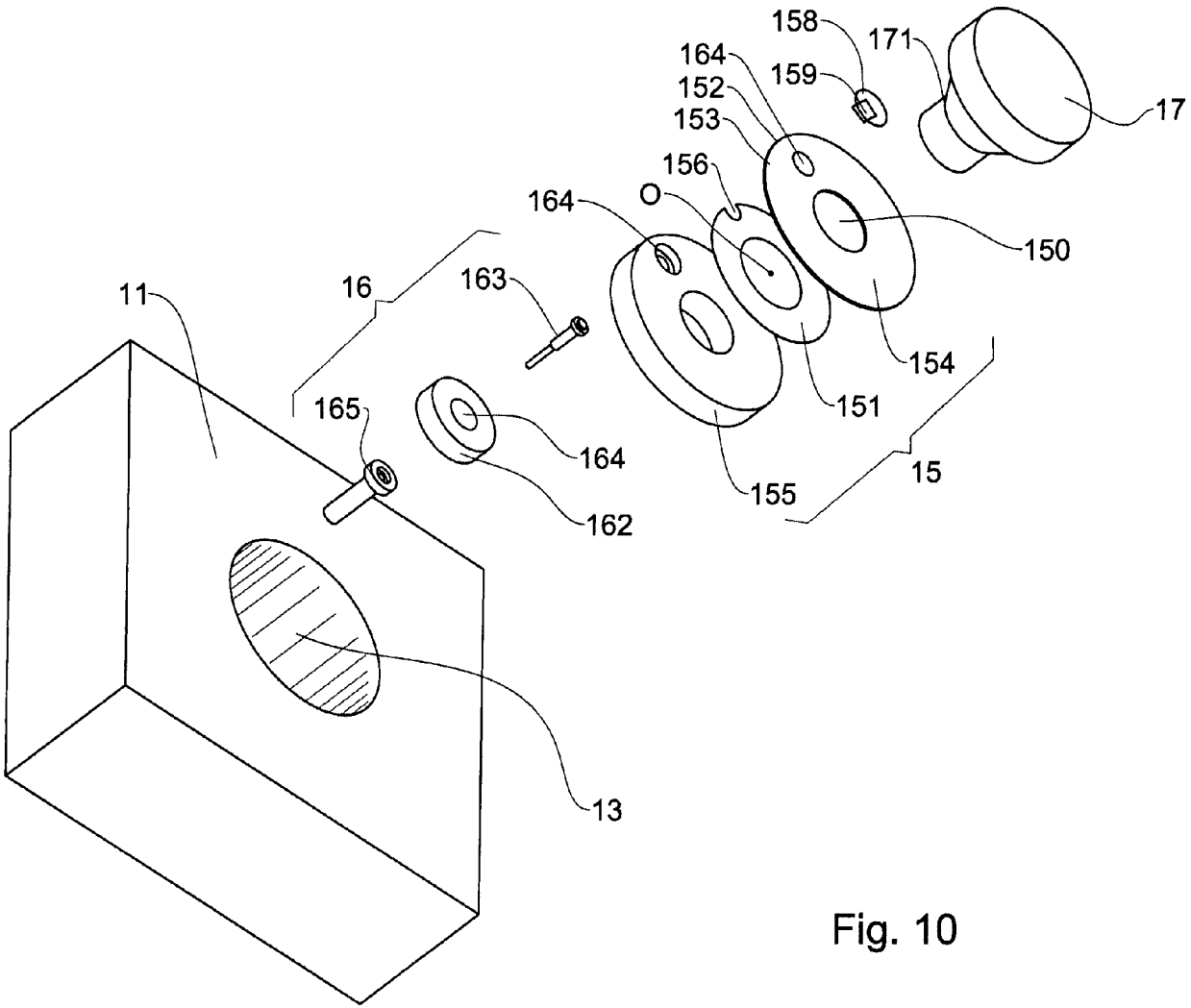
FIG. 10 shows an exploded perspective view of the single antenna element shown in FIG. 1, according to one embodiment of the present invention.

Referring to FIG. 1 and FIG. 10 together, the further part of the antenna element which is described hereinbelow in detail is the exciter 12. As described above, the exciter 12 includes the printed-circuit antenna 15 arranged within the cavity 13, and the feed arrangement 16 coupled to the printed-circuit antenna 15 at a feed point 161, for providing radio frequency energy thereto. A detailed description of embodiments of the printed-circuit antenna 15 and the feed arrangement 16 are described hereinbelow.

The printed-circuit antenna 15 has a layered structure and includes a supporting layer 152 having an underside 153 and an upper side 154. The supporting layer 152 is a thin layer of a dielectric material. As used throughout this description, the terms 'underside' and 'upper side' are referred to surfaces of the plates and layers in relation to the cavity of the waveguide (10 in FIG. 1). Specifically the surface that faces the bottom of the cavity is referred to as 'underside', whereas the surface that can be exposed in the aperture is referred to as 'upper side'.

Figure 11:
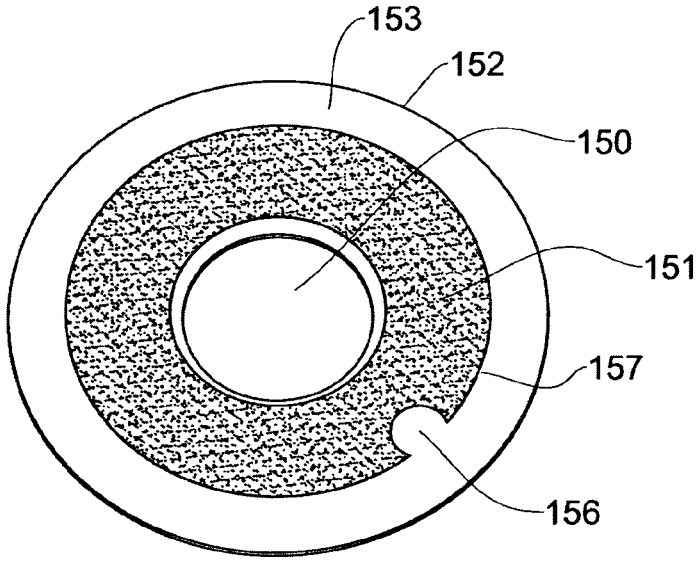
FIG. 11 shows a schematic underside view of the supporting layer of the printed-circuit antenna shown in FIG. 10, according to one embodiment of the present invention.

The printed-circuit antenna 15 also includes a patch 151. FIG. 11 shows a schematic perspective view of the supporting layer 152 turned upper side down, according to one embodiment of the present invention. As can be seen, the patch 151 is printed on the under-side 153 of the supporting layer 152.

Referring back to FIG. 1 and FIG. 10, the printed-circuit antenna 15 further includes a substrate 155 arranged between the patch 151 and the bottom 131 of the cavity 13. In accordance with one embodiment, the underside of the patch 151 is adhesively bonded onto an upper side of the substrate 155. The substrate 155 can fill a portion or entire volume of the cavity between the patch 151 and the bottom 131 of the cavity 13.

According to an embodiment, the patch 151, the supporting layer 152 and the substrate 155 are all have ring shapes hollowed out in the ring center. As shown in FIG. 1, this provision enables the holder 171 of the shield 17 to be inserted through the lumen 150 in the center of the layered structure formed by the patch 151, the supporting layer 152 and the substrate 155. Moreover, when desired, the metallic base 175 of the holder 171 can be threaded into the bottom of the cavity 13.

It should be appreciated that from an electromagnetic standpoint it is permitted to place the holder 171 within the center of the patch 151 since the voltage is zero at the center and as the current travels along one direction the voltage is positive, and while the current travels in the opposite direction the voltage is negative. As a result, placing a metallic object in the center of patch symmetric about its center does not disable the patch and does not prevent it from operating properly. The only effect of placing a metallic object is that the resonant frequency is altered.

It was found that the dielectric constant of the substrate can affect the bandwidth and resonant frequency of the antenna element. Accordingly, the dielectric constant of the substrate 155 arranged beneath the patch 151 must be chosen to optimize the performance of the antenna. One must be judicious in choosing the dielectric constant. Choosing a very high dielectric constant might reduce the bandwidth, however choosing a very low dielectric constant might make the exciter too large and unable to fit into the cavity.

An example of the dielectric material suitable for the substrate 155 includes, but is not limited to, ROHACELL® foam which can, for example, be produced by thermal expansion of a co-polymer sheet of methacrylic acid and methacrylonitrile. It should be noted that ROHACELL® foam is formed of a dielectric material having a dielectric constant nearly equivalent to the dielectric constant of air.

Referring to FIG. 11, the patch 151 includes an orifice 156 defining the location of the feed point (161 in FIG. 1). The orifice 156 can, for example, have a circular shape, however other shapes of the orifice are also contemplated. According to the embodiment shown in FIGS. 10 and 11, the orifice 156 is arranged at a verge 157 of the patch which is the distant edge from the center of the patch 151. In this case, the shape of the cut out portion of the orifice 156 has a shape of a partial circle. Alternatively, when desired, the orifice 156 can be arranged completely within the solid portion of the patch 151. In this case, the shape of the cut out portion can have a shape of a full circle.

Figure 12:
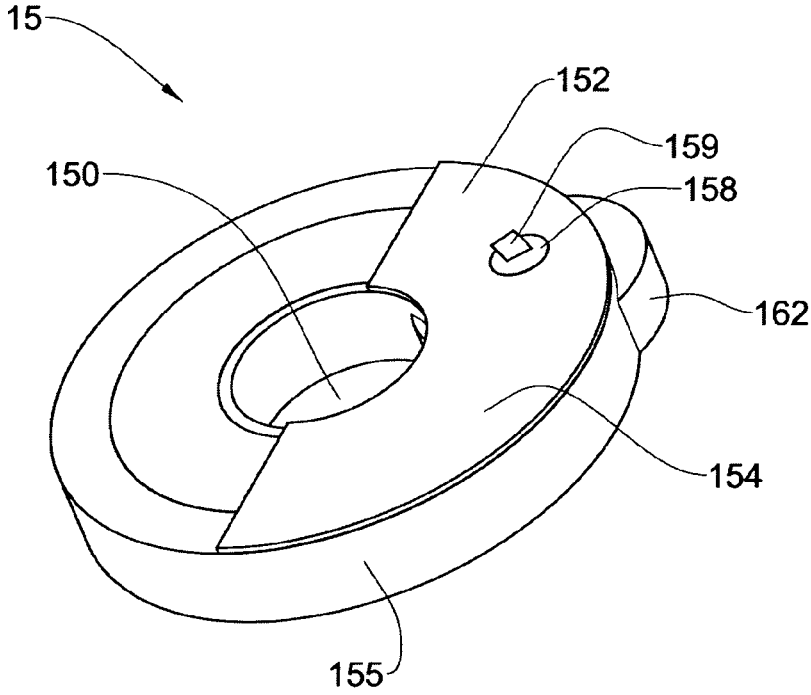
FIG. 12 shows a schematic view of the printed-circuit antenna, according to one embodiment of the present invention.

Referring to FIG. 12, the printed-circuit antenna 15 further includes a pad 158 and a stub 159 coupled to the pad 158. The pad 158 and the stub 159 are printed on the upper side 154 of the supporting layer 152 and mounted under the orifice (156 in FIG. 11) arranged in the patch (151 in FIG. 11). As shown in FIG. 12, the pad 158 has a circular shape, whereas the stub 159 has a rectangular shape; however other shapes for the pad and stub are contemplated.

The thickness of the supporting layer 152 should be as thin as possible. The reason for this is in order for the pad 158 and the stub 159 to be as close to the printed circuit patch 151 as possible, since the patch acts as a ground plane for the stub and the pad.

An example of the dielectric material suitable for the supporting layer 152 includes, but is not limited to epoxy glass, however other dielectric materials can also be suitable. The substrate 155 can, for example, be made of a dielectric material, however other materials, e.g., semiconducting ceramics, could also be used for substrate. It was found that the dielectric constant of the PC Board is of minor significance. Since the antenna is very thin, the dielectric constant of the PC Board is not a significant parameter. More important, are the mechanical characteristics of the material. Moreover, one needs a material which can be bonded onto the substrate 155.

Turning back to FIGS. 1 and 10, the feed arrangement 16 is formed as a direct current coaxial feed and includes an electrically conductive pin 163 and an electrically conductive sleeve 162 surrounding the pin 163. The electrically conductive sleeve 162 is arranged within the substrate 155 of the printed-circuit antenna 15 between the patch 151 and the bottom 131 of the cavity 13. The sleeve 162 can, for example, be made of metal or any other conductive material. According to one embodiment, the electrically conductive sleeve 162 is attached to the bottom 131 of the cavity. According to another embodiment, the sleeve 162 is formed in the cavity 13 and it is integrated with the waveguide 11.

The electrically conductive pin 163 passes through a common hole 164 arranged within the waveguide 11 at the bottom of the cavity 13, the sleeve 162 and the supporting layer 152. The pin 163 is connected to the pad 158 at the feed point 161 of the printed-circuit antenna 15. The connection of the pin 163 to the pad 158 can, for example, be carried out by soldering, welding, or by any other suitable technique. According to one embodiment, the pin 163 is surrounded with an isolator layer 165 made, for example, from teflon.

The pin 163 is coupled electromagnetically to the printed circuit patch 151. The pad 158 acts a capacitor in series with the pin 163. The pad 158 and the stub 159 together act as a reactive transmission line in which the patch 151 acts as its ground plane. The purpose of the stub 159 is to tune the patch 151 to 50 ohms or to any other impedance desired. The stub 159 can also increase the bandwidth of the antenna element.

It should be appreciated that the antenna element described above has the ability to operate in any polarization chosen. This implies that the antenna element can provide vertical, horizontal or circular polarized radiation. When desired, the radiation can be polarized to 45 degrees or any other polarization desired. The reason is that the polarization is determined by the position of the feed point 161 with respect to the printed circuit patch 151. Since the patch 151 is symmetric the feed point 161 can be located in any position desired. If circular polarization is desired, two feed points and, correspondingly, two coaxial feed arrangements can be used placed orthogonally to each other and phased 90° apart to achieve circular polarization.

As discussed above, the configuration and parameters of the antenna element and the array antenna structure significantly affect their performance. Several examples of the dependencies of the geometric dimensions of the waveguide (11 in FIG. 1) and to the shield (17 in FIG. 1) have been shown above. As will be illustrated hereinbelow, the configuration and parameters of the exciter (12 in FIG. 1) also significantly affect the antenna performance. Simulations were done to check the effect of the various parameters of the printed-circuit antenna (15 in FIG. 1) and the feed arrangement (16 in FIG. 1) on the performance of the antenna element (10 in FIG. 1).

Figure 13A:
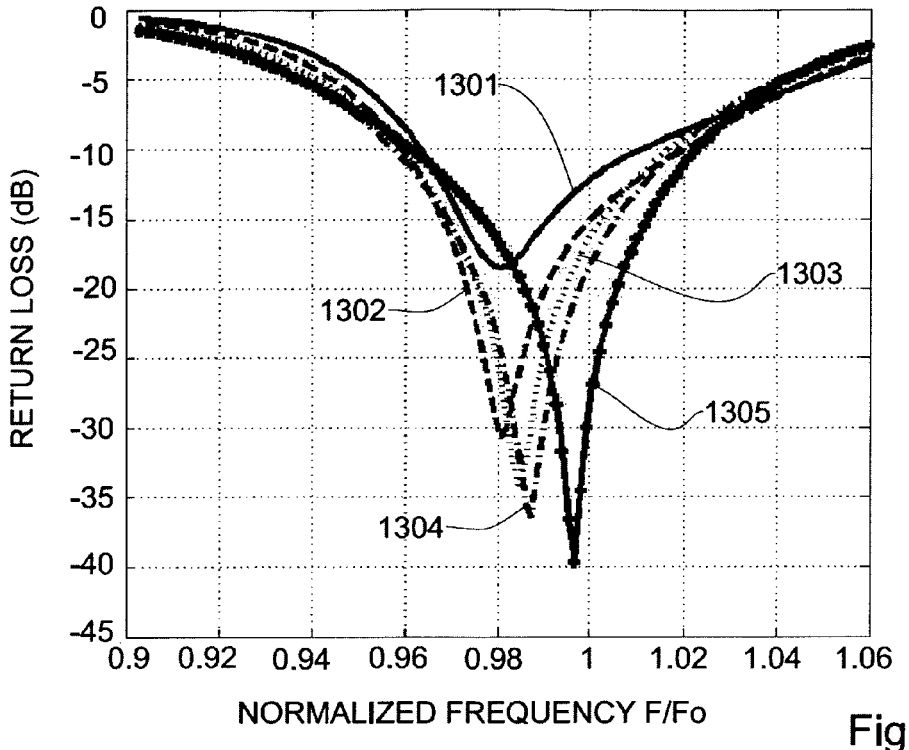
FIG. 13A illustrates exemplary graphs depicting the frequency dependence of the input reflection coefficient for antenna element shown in FIG. 1 for various values of the outer radius of the printed circuit patch of the exciter.

FIG. 13A shows an example obtained by computer simulations of the effect of variation of the outer radius $r_{outer}$ of the printed circuit patch (151 in FIG. 11) on the resonant frequency and bandwidth of the antenna element (10 in FIG. 1), while the other design parameters are held constant. The computer simulations were carried out when the outer radius $r_{outer}$ of the printed circuit patch was set to 0.157 λo (curve 1301), 0.160 λo (curve 1302), 0.162 λo (curve 1303), 0.165 λo (curve 1304) and 0.167 λo (curve 1305), correspondingly.

As one can see, the resonant frequency varies with outer radius of the patch 151. As one can see, the resonant frequency decreases with decrease in the patch radius. It was found by the applicant that the behavior of the resonant frequency of the antenna element, in which the patch is enclosed within a cavity, differs from the behavior of a conventional patch, in which the resonant frequency usually increases with decrease in the patch radius.

Figure 13B:
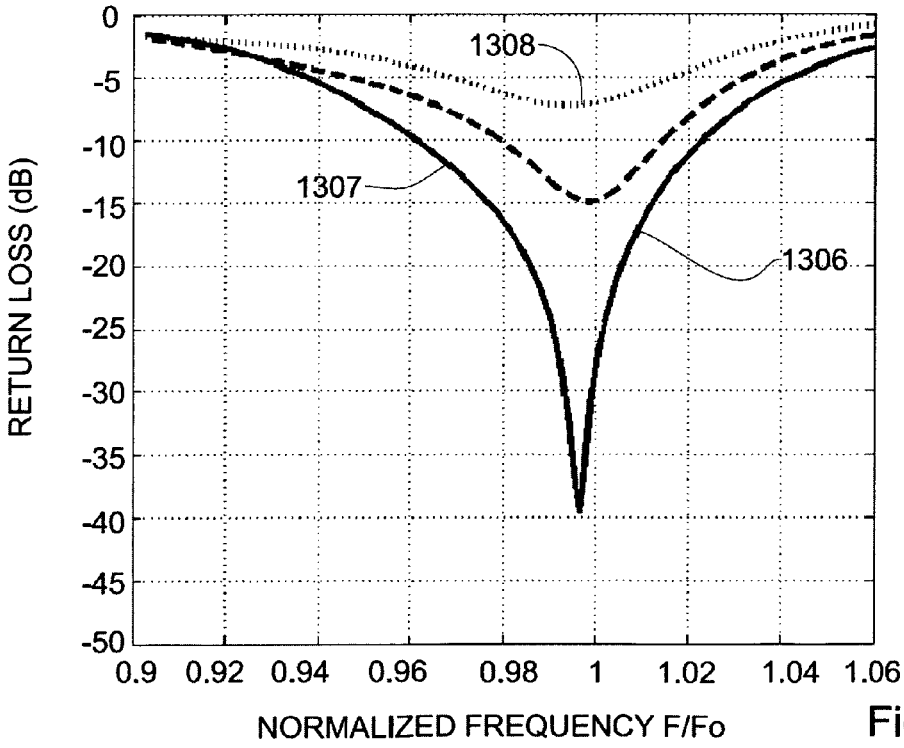
FIG. 13B illustrates exemplary graphs depicting the frequency dependence of the input reflection coefficient for antenna element shown in FIG. 1 for various values of the inner radius of the printed circuit patch of the exciter.

The next parameter analyzed was the inner radius $r_{inner}$ of the printed circuit patch (151 in FIG. 11A). The simulation shown below illustrates the return loss of the antenna for three inner radii. FIG. 13B shows an example obtained by computer simulations of the effect of variation of the inner radius $r_{inner}$ of the printed circuit patch (151 in FIG. 11A) on the resonant frequency and bandwidth of the antenna element (10 in FIG. 1), while the other design parameters are held constant. The computer simulations were carried out when the inner radius $r_{inner}$ of the printed circuit patch was set to 0.085 λo (curve 1306), 0.09 λo (curve 1307) and 0.095 λo (curve 1308), correspondingly. As one can see, the inner radius affects the return loss of the antenna. In order for the antenna return loss to be optimal, the inner radius must be chosen carefully. In this example, the optimum inner radius equals 0.085 λo, which is large by 0.01 λo than the radius of the uniform portion 174 of the holder 171.

Figure 14:
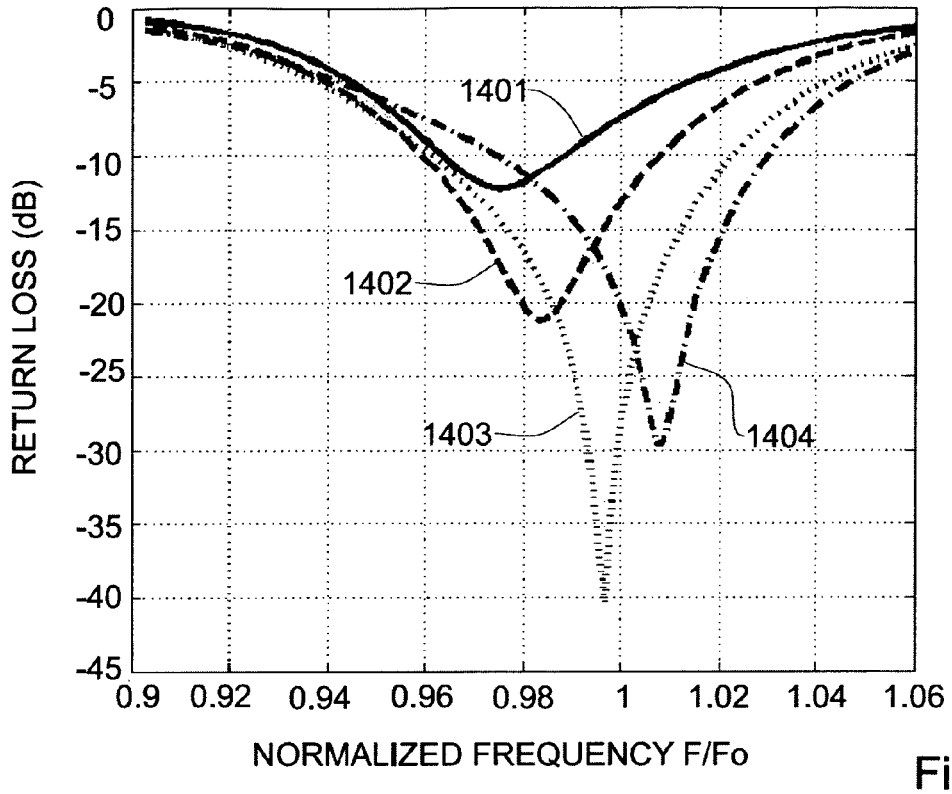
FIG. 14 illustrates exemplary graphs depicting the frequency dependence of the input reflection coefficient for antenna element shown in FIG. 1 for various values of the thickness of the substrate.

The next parameter analyzed was the thickness s of the substrate (155 in FIG. 1) arranged underneath the patch (151 in FIG. 1). FIG. 14 shows an example obtained by computer simulations of the effect of variation of the thickness s of the substrate on the resonant frequency of the antenna element (10 in FIG. 1), while the other design parameters are held constant. The computer simulations were carried out when the thickness s was set to 0.045 λo (curve 1401), 0.055 λo (curve 1402), 0.065 λo (curve 1403), 0.075 λo (curve 1404).

As one can see, the thickness of the substrate has a direct effect on the bandwidth and resonant frequency of the antenna. For example, in order that an antenna properly operate between 0.975 fo and 1.02 fo (where fo=c/λo, and c is the light velocity), one can choose a thickness of 0.065 λo.

As described above with reference to FIG. 11, the patch 151 has the orifice 156 that defines the location of the feed point 161. The pin 163 is coupled electromagnetically to the patch. The diameter of orifice 156 has a profound effect on strength of the coupling of the pin to the patch.

Figure 15:
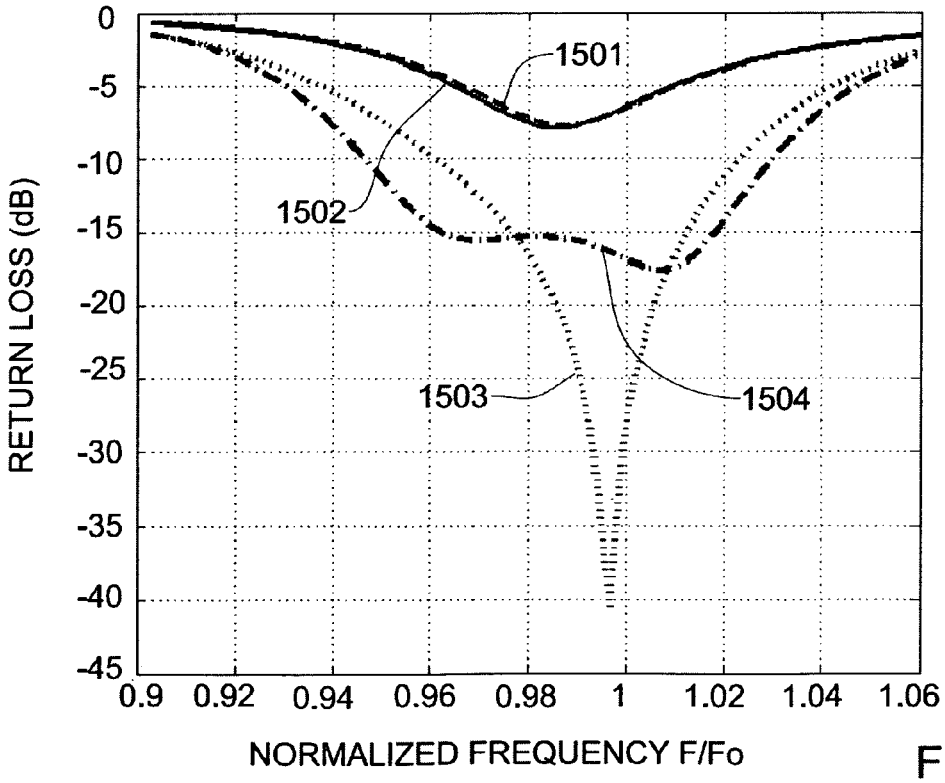
FIG. 15 illustrates exemplary graphs depicting the frequency dependence of the input reflection coefficient for antenna element shown in FIG. 1 for various values of the radius of orifice in the patch.

FIG. 15 shows an example obtained by computer simulations of the effect of variation of the radius of orifice 156 in the patch 151 on the resonant frequency and bandwidth of the antenna element (10 in FIG. 1), while the other design parameters are held constant. The computer simulations were carried out when the radius of orifice 156 was set to 0.019 λo (curve 1501), 0.021 λo (curve 1502), 0.023 λo (curve 1503), and 0.025 λo (curve 1504), correspondingly.

As one can see from FIG. 15, the variation of the radius of orifice 156 in a relatively broad range between 0.019 λo and 0.021 λo does not change the frequency behavior of the return losses (see curves 1501 and 1502). However, the small variation of the orifice between 0.023 λo and 0.025 λo (see curve 1503 and 1504) brings the coupling to optimum. At the radius of 0.023 λo the antenna is resonant at desired frequency.

Figure 16:
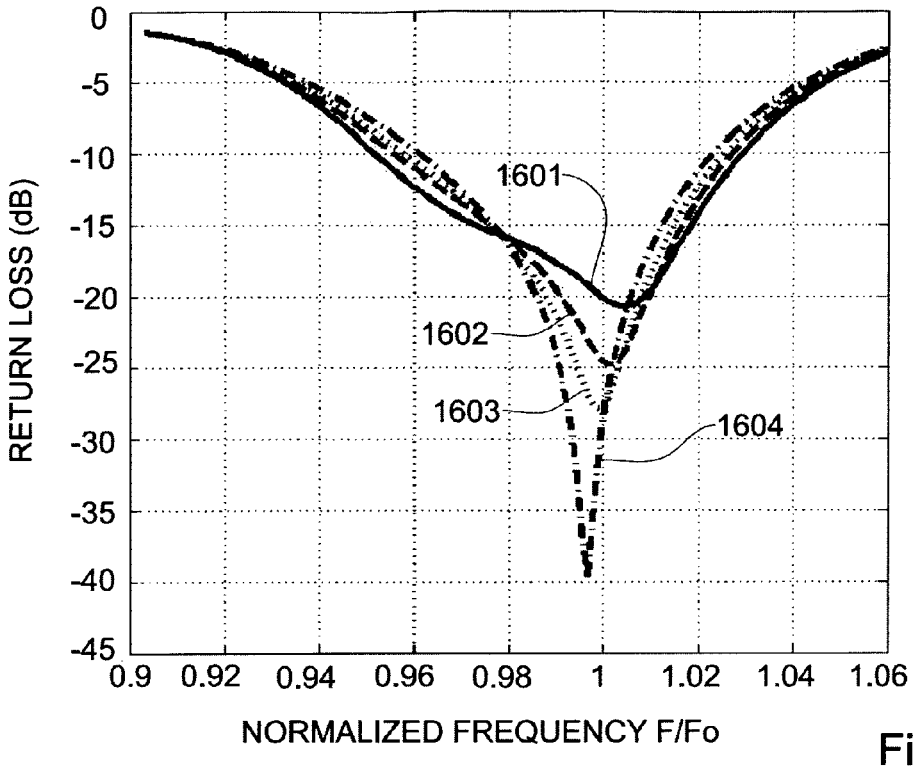
FIG. 16 illustrates exemplary graphs depicting the frequency dependence of the input reflection coefficient for antenna element shown in FIG. 1 for various values of the radius of the pad.

The next parameter analyzed was the radius $R_{pad}$ of the pad 158. Simulations were done to determine the effect of modifying the radius of the pad. FIG. 16 shows an example obtained by computer simulations of the effect of variation of the radius $R_{pad}$ of the pad on the resonant frequency of the antenna element (10 in FIG. 1), while the other design parameters are held constant. The computer simulations were carried out when the radius $R_{pad}$ was set to 0.017 λo (curve 1601), 0.018 λo (curve 1602), 0.020 λo (curve 1603), and 0.022 λo (curve 1604). As one can see, there is an optimal pad radius equal to 0.022 λo which gives the maximum bandwidth and best possible return loss.

Figure 17A:
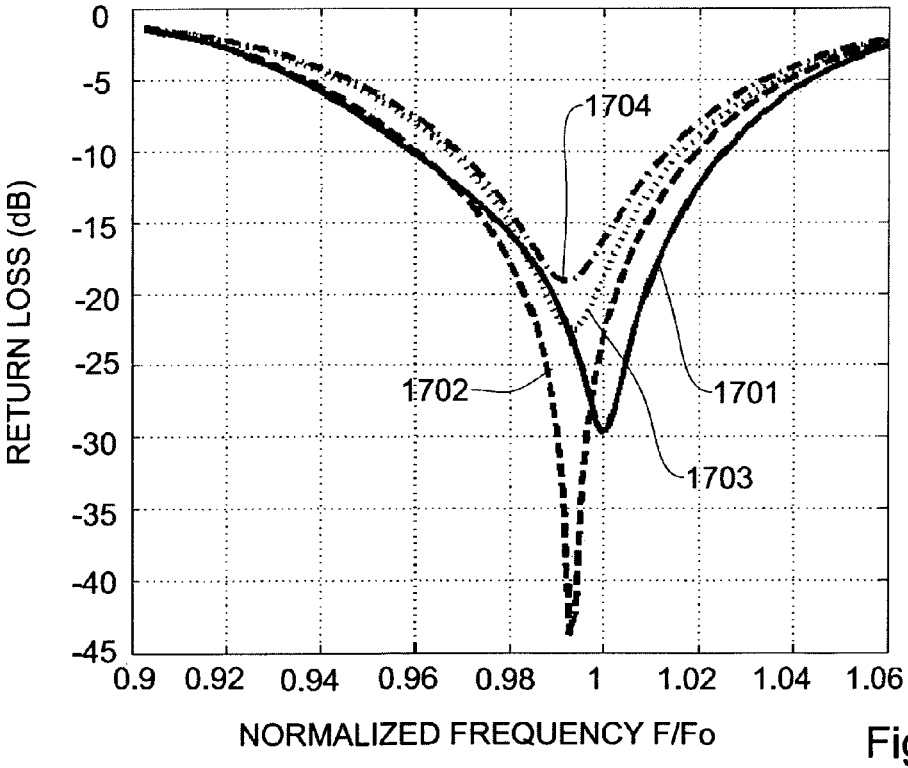
FIG. 17A illustrates exemplary graphs depicting the frequency dependence of the input reflection coefficient for antenna element shown in FIG. 1 for various values of the length of the microstrip stub.
Figure 17B:
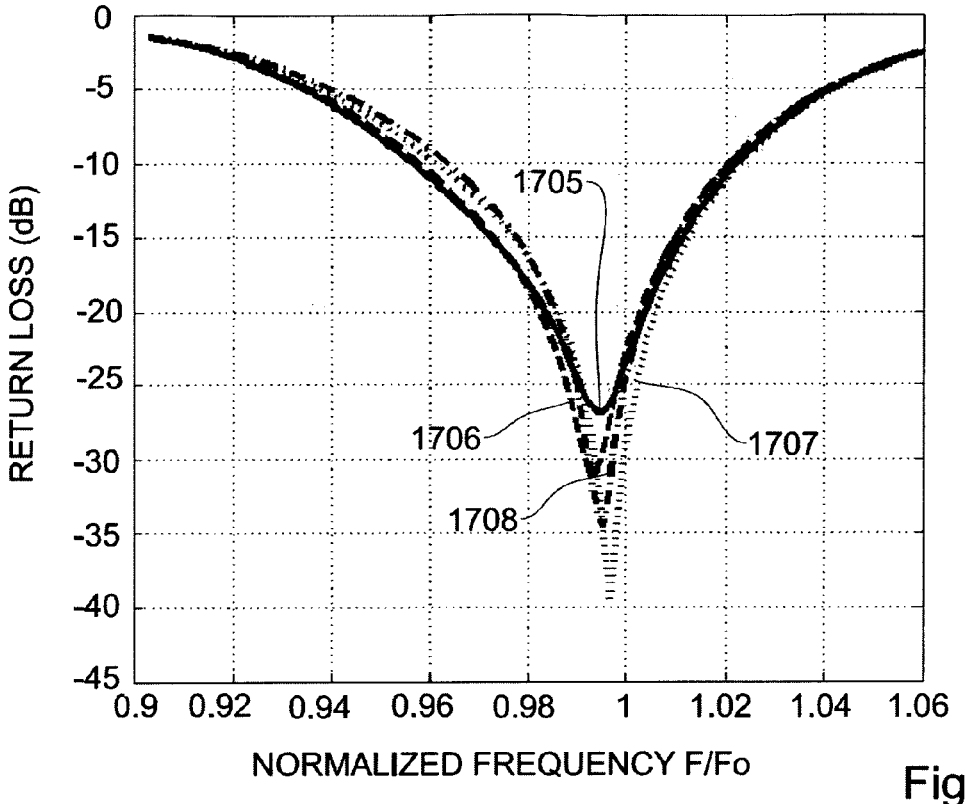
FIG. 17B illustrates exemplary graphs depicting the frequency dependence of the input reflection coefficient for antenna element shown in FIG. 1 for various values of the width of the microstrip stub.

The further analyzed parameters are the length $L_{stub}$ and the width $W_{stub}$ of the stub 159 when the stub has a rectangular shape (as shown in FIG. 12). As described above, the stub 159 can be a microstrip line connected to the microstrip pad 158 and configured to tune the patch 151. FIGS. 17A and 17B show, correspondingly, examples obtained by computer simulations of the effect of variation of the length and width of the stub 159 on the resonant frequency and bandwidth of the antenna element (10 in FIG. 1), while the other design parameters are held constant. The computer simulations were carried out when the length $L_{stub}$ was set to 0.031 λo (curve 1701), 0.0425 λo (curve 1702), 0.054 λo (curve 1703), 0.060 λo (curve 1704), correspondingly, and when the width $W_{stub}$ was set to 0.01 λo (curve 1705), 0.0163 λo (curve 1706), 0.0225 λo (curve 1707), 0.0288 λo (curve 1708).

As can be seen from FIG. 17A, the length $L_{stub}$ of the microstrip stub affects the bandwidth and resonant frequency of the antenna element. Accordingly, there is an optimal stub length which gives the maximum bandwidth and optimal return loss. On the other hand, as can be seen from FIG. 17B, the width $W_{stub}$ of the stub has a minor influence on the antenna in this configuration.

Figure 18:
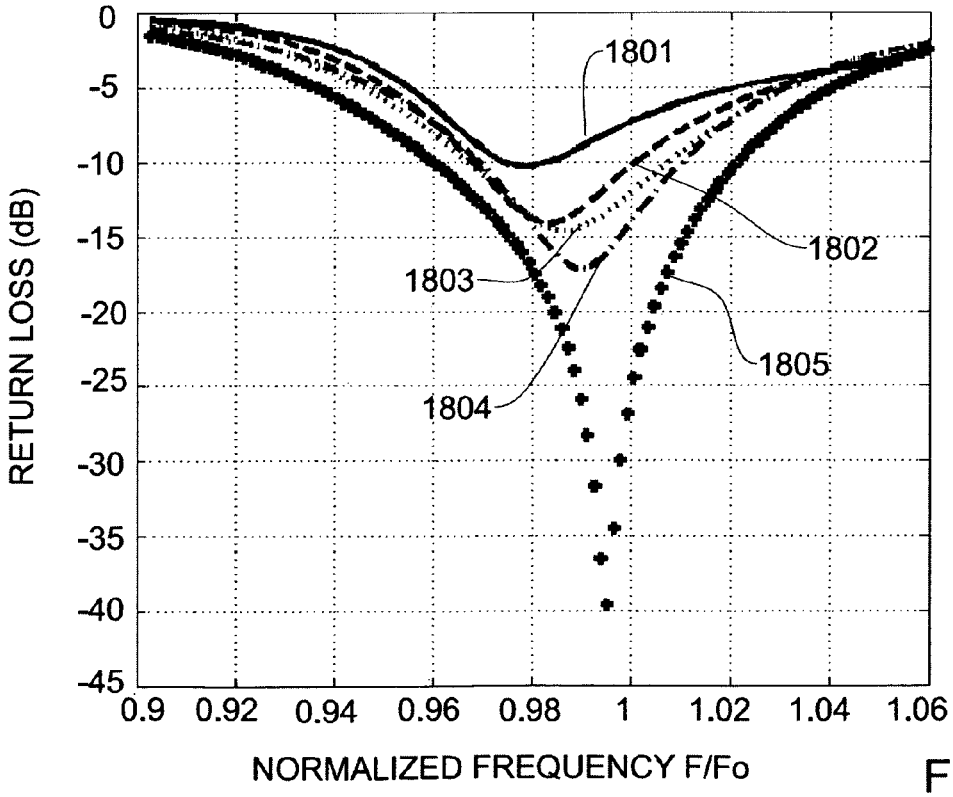
FIG. 18 illustrates exemplary graphs depicting the frequency dependence of the input reflection coefficient for antenna element shown in FIG. 1 for various values of the distance of the pin from the center of the patch.

It was also found that the distance of the feed point 161 from the center O of the patch 151 has a very noticeable effect on the impedance of the patch 151. FIG. 18 shows an example obtained by computer simulations of the effect of variation of the distance of the feed point from the center of the patch 151 on the resonant frequency and bandwidth of the antenna element (10 in FIG. 1), while the other design parameters are held constant. The computer simulations were carried out when the distance of the feed point 161 from the center O was set to 0.08 λo (curve 1801), 0.0875 λo (curve 1802), 0.095 λo (curve 1803), 0.1025 λo (curve 1804), and 0.11 λo (curve 1805).

As can be seen from FIG. 18, the distance of the feed point 161 from the center O affects the bandwidth and resonant frequency of the antenna element. Accordingly, there is an optimal stub length which gives the maximum bandwidth and optimal return loss. Thus, a major part of the design effort is the proper placement of the (pin 163 in FIG. 10) from the center of the patch 151.

Turning back to FIGS. 1, 10 and 12 together, another important parameter in the construction of the antenna element is the electrically conductive sleeve 162 which surrounds the pin 163 and the isolator layer 165. It should be understood that the height of the sleeve 162 behaves as an inductance, whereas the diameter behaves like a capacitor in series with the pin 163.

Figure 19A:
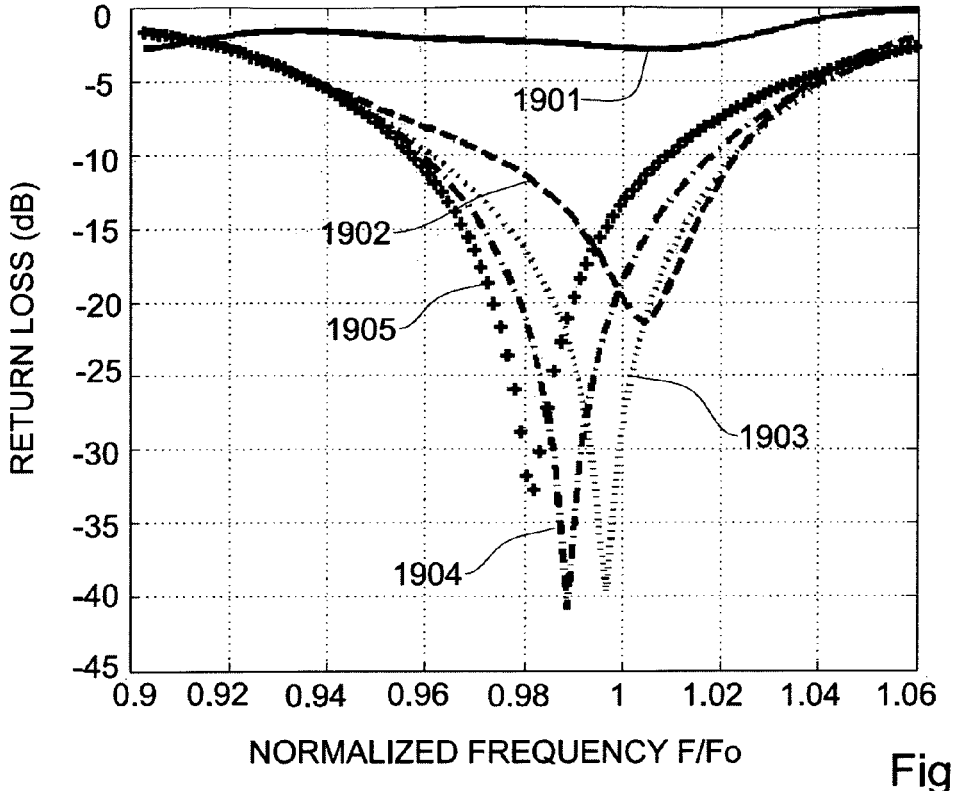
FIG. 19A illustrates exemplary graphs depicting the frequency dependence of the input reflection coefficient for antenna element shown in FIG. 1 for various values of the height of the sleeve.
Figure 19B:
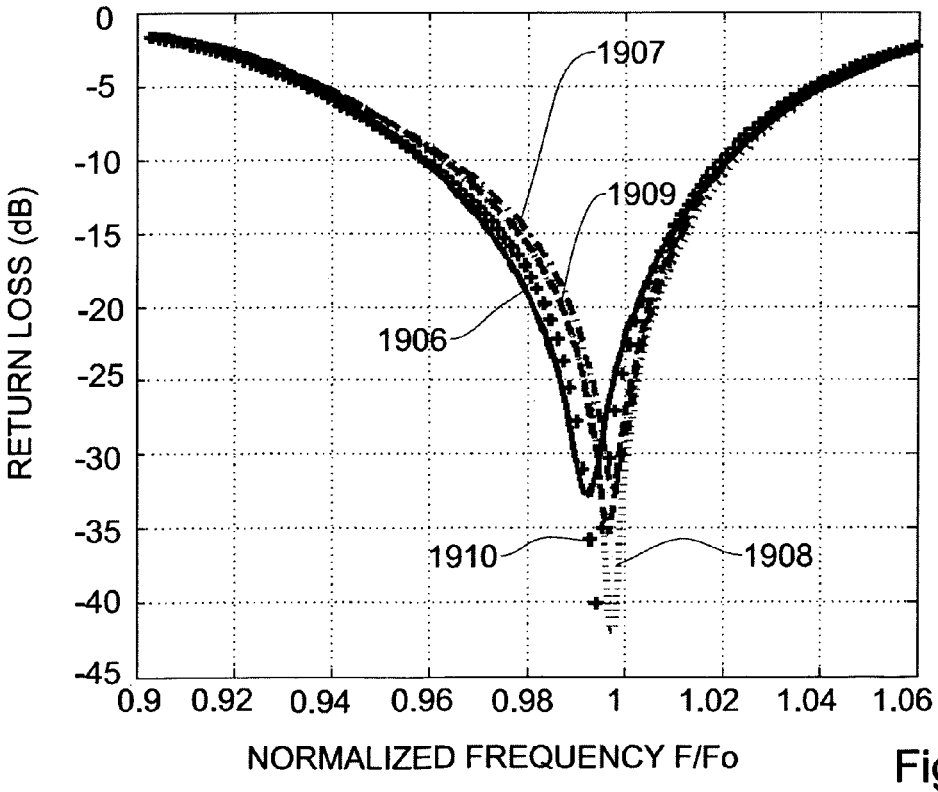
FIG. 19B illustrates exemplary graphs depicting the frequency dependence of the input reflection coefficient for antenna element shown in FIG. 1 for various values of the radius of the sleeve.

FIGS. 19A and 19B show, correspondingly, examples obtained by computer simulations of the effect of variation of the height and radius of the sleeve 162 on the resonant frequency and bandwidth of the antenna element (10 in FIG. 1), while the other design parameters are held constant. The computer simulations were carried out when the height of the sleeve was set to 0.0064 λo (curve 1901), 0.0128 λo (curve 1902), 0.0154 λo (curve 1903), 0.0184 λo (curve 1904), 0.0240 λo (curve 1905), correspondingly, and when the radius of the sleeve was set to 0.008 λo (curve 1906), 0.0010 λo (curve 1907), 0.0125 λo (curve 1908), 0.0148 λo (curve 1909), and 0.017 λo (curve 1910).

As one can see from FIG. 19A, varying the height of the sleeve has a significant effect on the impedance and bandwidth of the element. Accordingly, there is an optimal sleeve height which gives the maximum bandwidth and optimal return loss. On the other hand, as can be seen from FIG. 19B, the radius of the sleeve has a minor influence on the antenna in this configuration.

Turning back to FIG. 1, a further parameter which is important for the construction of the antenna element is the thickness of the radome 19 placed on top of antenna element to prevent dust and dirt from entering the slots of the antenna. The radome affects to a very large extent the resonant frequency of the antenna. The extent of the radome's influence depends on the thickness and dielectric constant of the radome 19.

Figure 20:
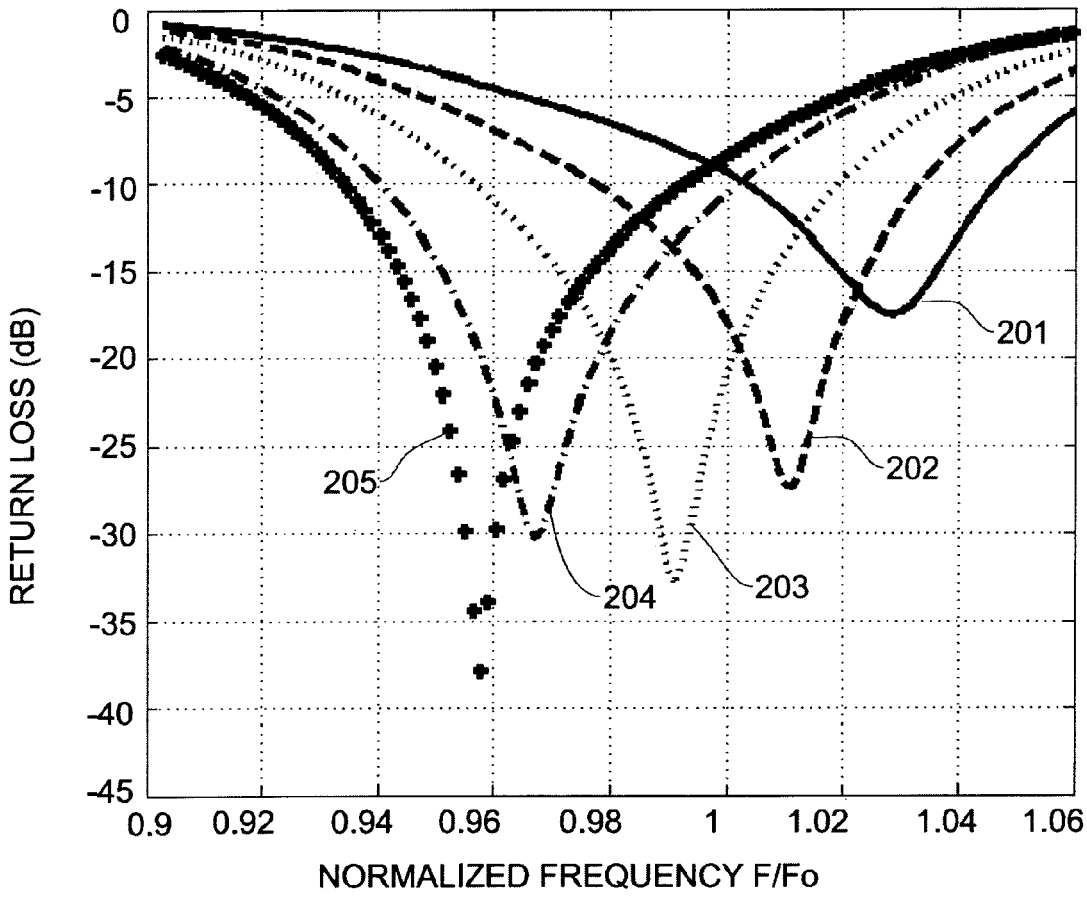
FIG. 20 illustrates exemplary graphs depicting the frequency dependence of the input reflection coefficient for antenna element shown in FIG. 1 for various values of the thickness of the radome.

FIG. 20 shows an example obtained by computer simulations of the effect of variation of the thickness of the radome on the resonant frequency and bandwidth of the antenna element (10 in FIG. 1), while the other design parameters are held constant. The computer simulations were carried out when the thickness of the radome 19 was set to 0.002 λo (curve 201), 0.0037 λo (curve 202), 0.0054 λo (curve 203), 0.0071 λo (curve 204), 0.008 λo (curve 205), correspondingly. As can be seen from FIG. 20, even a small change in the radome thickness has a very strong influence on the resonant frequency and bandwidth of the antenna. The thicker the radome, the greater the impact on the antenna resonant frequency. Moreover, the higher the dielectric constant, the greater the effect the radome has on the resonant frequency of the antenna.

As such, those skilled in the art to which the present invention pertains, can appreciate that while the present invention has been described in terms of preferred embodiments, the conception, upon which this disclosure is based, may readily be utilized as a basis for the designing of other structures systems and processes for carrying out the several purposes of the present invention.

The antenna of the present invention may be utilized in various intersystems, e.g., in communication within the computer wireless LAN (Local Area Network), PCN (Personal Communication Network) and ISM (Industrial, Scientific, Medical Network) systems.

The antenna may also be utilized in communications between a LAN and cellular phone network, GPS (Global Positioning System) or GSM (Global System for Mobile communication).

It is to be understood that the phraseology and terminology employed herein are for the purpose of description and should not be regarded as limiting.

It is important, therefore, that the scope of the invention is not construed as being limited by the illustrative embodiments set forth herein. Other variations are possible within the scope of the present invention as defined in the appended claims. Other combinations and sub-combinations of features, functions, elements and/or properties may be claimed through amendment of the present claims or presentation of new claims in this or a related application. Such amended or new claims, whether they are directed to different combinations or directed to the same combinations, whether different, broader, narrower or equal in scope to the original claims, are also regarded as included within the subject matter of the present description.

The invention claimed is:

1. An antenna element comprising:

a waveguide including a cavity having an aperture;

an exciter mounted at a bottom of the cavity and configured for exciting the waveguide; and a shield formed from a hard and strong material to provide protection to the exciter from predetermined damaging actions, the shield including:

a holder arranged within the cavity and extending from the bottom of the cavity along the cavity depth; and a front plate mounted on the holder, and being substantially flush with the aperture and disposed over at least a part of the exciter, thereby providing said protection from predetermined damaging actions.

2. The antenna element of claim 1, wherein the exciter includes:

a printed-circuit antenna arranged at the bottom of the cavity and configured for feeding the waveguide; and a feed arrangement coupled to the printed-circuit antenna at a feed point for providing radio frequency energy thereto.

3. The antenna element of claim 2, wherein said printed-circuit antenna has a layered structure and includes:

a thin layer of a dielectric material having an underside and an upper side;

a patch printed on the underside of the thin layer, and a substrate arranged between the patch and a bottom of the cavity.

4. The antenna element of claim 3, wherein the patch includes an orifice defining the location of the feed point.

5. The antenna element of claim 4, wherein the orifice is arranged at a verge of the patch, which is the distant edge from the center of the patch.

6. The antenna element of claim 4, wherein the orifice is arranged within the solid portion of the patch.

7. The antenna element of claim 4, wherein said printed-circuit antenna includes a pad and a stub coupled to the pad, the pad and the stub are printed on the upper side of the thin layer and arranged under the orifice of the patch.

8. The antenna element of claim 7, wherein the feed arrangement includes an electrically conductive pin, and an electrically conductive sleeve arranged within the substrate between the patch and the bottom of the cavity and surrounding the pin.

9. The antenna element of claim 8, wherein the pin passes through a common hole arranged within the waveguide at the bottom of the cavity, the electrically conductive sleeve and the thin layer.

10. The antenna element of claim 8, wherein the pin is surrounded with an isolator layer.

11. The antenna element of claim 3, wherein the waveguide is a circular waveguide, and wherein the patch, the thin layer and the substrate all have ring shapes hollowed out in the ring center to define a lumen.

12. The antenna element of claim 11, wherein the holder of the shield is inserted through the lumen in the center of the layered structure formed by the patch, the thin layer and the substrate.

13. The antenna element of claim 2, wherein the holder has a tubular shape and includes a tapered portion and a uniform portion, said tapered portion is tapered with contraction from the front plate towards a uniform portion located at a bottom of the cavity.

14. The antenna element of claim 13, wherein the contraction of the holder extends from the front plate until the location of the printed-circuit antenna.

15. The antenna element of claim 1 further comprising a radome mounted on the top of the antenna element over the aperture.

16. The antenna element of claim 1, wherein the holder has a tubular shape and includes a tapered portion having a varied diameter, and a uniform portion having a uniform diameter.

17. The antenna element of claim 16, wherein the tapered portion is tapered with contraction from the front plate towards the uniform portion that is located at a bottom of the cavity.

18. A phased array antenna comprising:

a plurality of the antenna elements of claim 1 having waveguides arranged in a common conductive ground plane and spaced apart at a predetermined distance from each other; and a beam steering system coupled to said a plurality of the antenna elements and configured for steering an energy beam produced by said phased array antenna.

19. The phased array antenna of claim 18, wherein the waveguides of said plurality of the antenna elements are arranged in a common conductive ground plane.

20. The phased array antenna of claim 18, wherein at least one waveguide of said plurality of the antenna elements is arranged in an individual conductive ground plane.

* * * * *